US007575421B2

(12) United States Patent
McAuliffe et al.

(10) Patent No.: US 7,575,421 B2
(45) Date of Patent: Aug. 18, 2009

(54) INTEGRAL MOTOR COOLING AND COMPRESSOR INLET

(75) Inventors: Christopher McAuliffe, Windsor, CT (US); Craig Beers, Wethersfield, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 714 days.

(21) Appl. No.: 10/978,641

(22) Filed: Nov. 1, 2004

(65) Prior Publication Data

US 2006/0073030 A1 Apr. 6, 2006

Related U.S. Application Data

(60) Provisional application No. 60/611,992, filed on Sep. 22, 2004.

(51) Int. Cl.
*F04B 39/02* (2006.01)
*F04B 39/06* (2006.01)

(52) U.S. Cl. ..... 417/366; 417/369; 417/370; 417/423.8

(58) Field of Classification Search ..... 417/366, 417/369, 370, 423.8
See application file for complete search history.

(56) References Cited

U.S. PATENT DOCUMENTS 4,714,405 A * 12/1987 Schaefer et al. ..... 415/168.2
5,165,849 A * 11/1992 Nakagawa et al. ..... 415/208.1
6,102,672 A * 8/2000 Woollenweber et al. ..... 417/366

* cited by examiner

*Primary Examiner*—Charles G Freay
*Assistant Examiner*—Peter J Bertheaud
(74) *Attorney, Agent, or Firm*—Carlson, Gaskey & Olds

(57) ABSTRACT

A compressed air unit is provided having a motor housing with a main motor housing having a cavity. A motor is arranged within the cavity and a compressor rotor is connected to the motor. A cooling duct is integral with and extends from the main housing body. The cooling duct is in fluid communication with the cavity. An inner housing includes a main inlet housing body providing a compressor inlet for providing fluid to the compressor rotor. An inlet duct is integral with and extends from the main inlet housing body and in fluid communication with the compressor inlet. A transfer tube is interconnected between the cooling and inlet ducts. A source of clean cooling air is provided by providing a reverse flow pickup from the inlet flow boundary layer at the compressor inlet.

6 Claims, 1 Drawing Sheet

INTEGRAL MOTOR COOLING AND COMPRESSOR INLET

The present application claims priority to U.S. Provisional Patent Application Ser. No. 60/611,992, filed Sep. 22, 2004.

BACKGROUND OF THE INVENTION

This invention relates to a compressed air unit having integral motor cooling and compressor inlet housings.

A compressed air unit used, for example, for supplying compressed air to an air cycle air conditioning system employs a compressor rotor. The compressor rotor is driven by a shaft. The compressor rotor is provided air on an inlet side of the rotor by an inlet housing. External cooling lines have been secured to the inlet housing by threaded fitting to supply clean air to various aircraft components.

Electric motors include rotor assemblies having shafts that are rotatably driven by a magnetic field from a stator. The stator and rotor assembly are arranged within a motor housing. The shaft is supported on bearings. The stator must be provided with a clean source of clean air so as to not contaminate the interior of the housing, especially in applications that utilize air bearings.

The electric motor and compressor rotor are typically arranged remote from one another in unrelated systems. What is needed is a simple and efficient apparatus and method for providing clean air to an electric motor that is used to drive a compressor rotor.

SUMMARY OF THE INVENTION

The present invention provides a compressed air unit having a motor housing with a main motor housing having a cavity. A motor is arranged within the cavity and a compressor rotor is connected to the motor. A cooling duct is integral with and extends from the main housing body. The cooling duct is in fluid communication with the cavity. An inlet housing includes a main inlet housing body providing a compressor inlet for providing fluid to the compressor rotor. An inlet duct is integral with and extends from the main inlet housing body and is in fluid communication with the compressor inlet.

A transfer tube is interconnected between the cooling and inlet ducts, for example, in a slip fit relationship. In one example, the transfer tube is retained between the inlet and cooling ducts when the motor and inlet housings are secured to one another.

A source of clean cooling air is provided to the motor by providing a reverse flow pickup from the inlet flow boundary layer at the compressor inlet. An annular supply cavity is provided by the inlet housing and is in fluid communication with the compressor inlet and the inlet duct. The supply cavity has a wall and a first flange canted relative to the wall that directs the fluid entering the supply cavity in a flow direction that is transverse to the flow direction within the inlet duct. In this manner, debris within the air collects in a pocket formed by the first flange and wall since the air is forced to make a sharp turn within the supply cavity.

Accordingly, the present invention provides a simple and efficient apparatus and method for providing clean air to an electric motor that drives a compressor rotor.

These and other features of the present invention can be best understood from the following specification and drawings, the following of which is a brief description.

DETAILED DESCRIPTION OF THE PREFERRED EMBODIMENT

Figure 1:
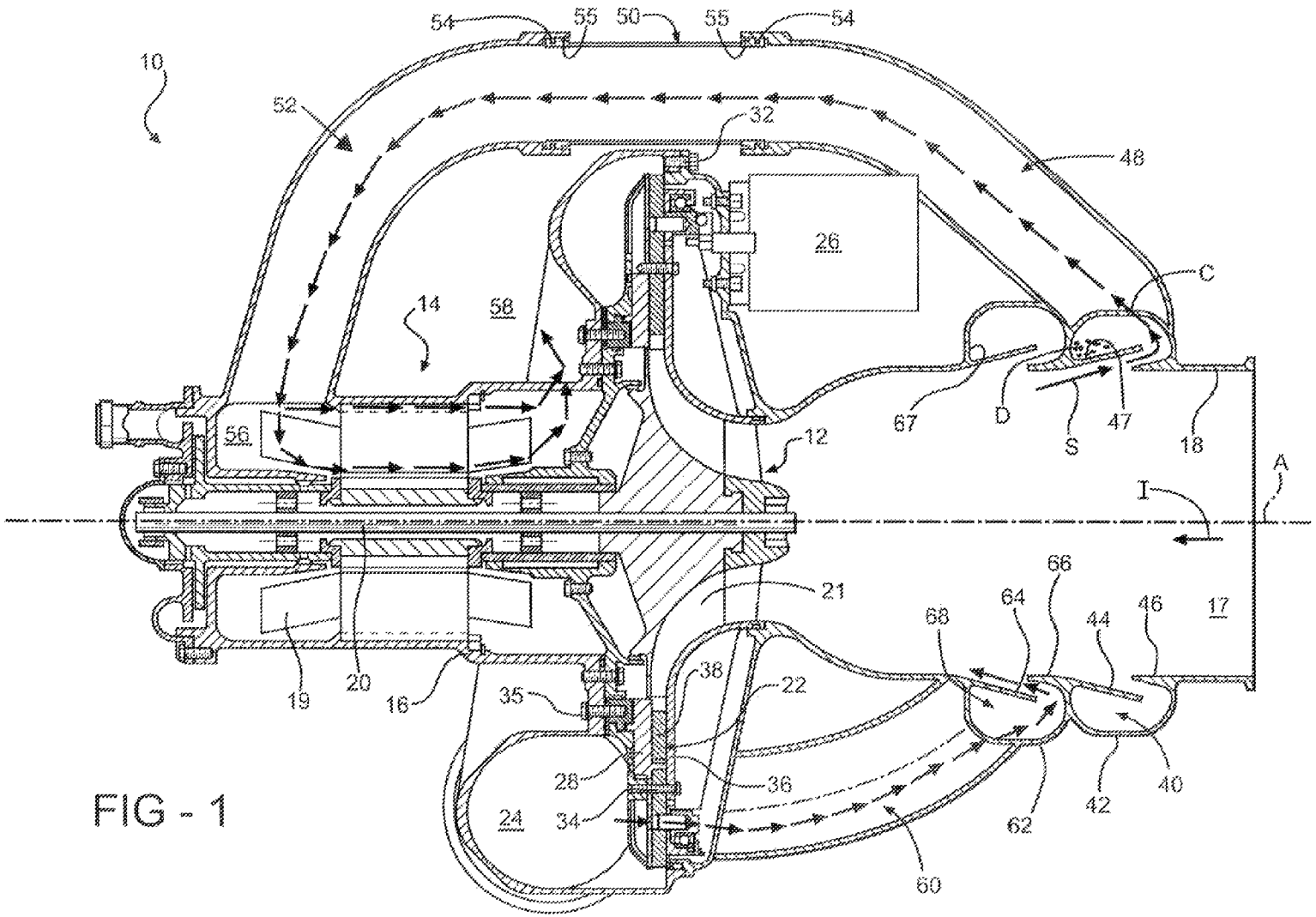
FIG. 1 is a cross-sectional view of an inventive compressed air unit.

A compressed air unit 10 is shown in FIG. 1. The unit 10 includes a compressor rotor 12 supported on a shaft 20 that is driven by an electric motor 14. The electric motor 14 is arranged within a motor housing. An inlet housing 18 provides a compressor inlet 17 for providing air to the compressor rotor 12.

The compressor rotor 12 includes rotor blades 21 that compress air from the compressor inlet 17 and provides the compressed air to a compressor outlet 24. A diffuser 22 is arranged between the compressor inlet 17 and the compressor outlet 24 for varying the flow rate to the compressed air unit 10.

The diffuser 22 is of the type capable of varying its area. The diffuser 22 includes a backing plate 28 operably secured to the motor housing 16 by fasteners 35. Adjustable vanes 38 are arranged between the backing plate 28 and a shroud 36. The shroud 36 and vanes 38 are secured relative to the backing plate 28 by bolts 34.

The motor and inlet housing 16 and 18 are provided by separate castings that are secured to one another by fasteners 32. The motor housing 16 has a main body with an integrally formed cooling duct 52. Similarly, the inlet housing 18 has a main body with an integrally formed inlet duct 48. A transfer tube 50 fluidly connects the inlet and cooling ducts 48 and 52. The inlet and cooling ducts 48 and 52 include openings 55. Seals 54 are arranged between the openings 55 of the inlet and cooling ducts 48 and 52 and the transfer tube 50.

The transfer tube 50 is in a slip-fit relationship with the inlet and cooling ducts 48 and 52. The transfer tube 50 is retained between the motor and inlet housing 16 and 18 upon securing the housing 16 and 18 to one another with the fasteners 32. The integral motor and inlet housing 16 and 18 and inlet and cooling ducts 48 and 52 together with the transfer tube 50 replace prior art external lines that use threaded fittings. In this manner, assembly and reliability of the unit 10 is improved.

Cooling air is provided through the inlet and cooling ducts 48 and 52 and transfer tube 50 to a cavity 56 within the motor housing 16. A stator 19 and air bearings, for example, are arranged within the cavity 56 which require a clean source of cooling. A supply cavity 40 is provided by the inlet housing 18 and is arranged between the compressor inlet 17 and inlet duct 48. The supply cavity 40 is an annular passage that is provided by a wall 42 and first and second flanges 44 and 46. The arrangement of the wall 42 and first and second flanges 44 and 46 provide a reverse flow pickup from an inlet flow boundary layer along the wall of the compressor inlet 17. This configuration prevents fluid flowing in an inlet flow direction I within the compressor inlet 17 from flowing directly through to the inlet duct 48 in a cooling flow direction C. That is, the supply cavity 40 forces the fluid to abruptly change directions to separate debris D from the fluid.

The first flange 44 is canted radially outward toward the wall 42 and in a direction generally opposite the inlet flow direction I. The second flange 46 extends in generally the inlet flow direction I. The first flange 44 is arranged radially outward of the second flange 46. The supply flow direction S entering the supply cavity 40 and the cooling flow direction C entering the inlet duct 48 are at an acute angle relative to one another in the example shown. The first flange 44 and wall 42 form a pocket 47 for collecting debris D that separates from the fluid as it is forced to abruptly change directions.

Clean air enters the cavity 56 where it can cool the stator 19 and air bearings, if applicable. The air is permitted to exit the motor housing 16 through a vent to a ram air circuit 58. The inlet housing 18 may also include an add-heat duct that fluidly connects the compressor outlet 24 and compressor inlet 17. An add-heat cavity 68 is arranged between the add-heat ducts 60 and the compressor inlet 17 in a configuration similar to the supply cavity 40 so as to avoid disturbing fluid flow to the compressor inlet 17. The add heat duct 60 is utilized when it is desired to raise the temperature at the compressor outlet 24 by recirculating compressed air back to the compressor inlet 17.

The add heat cavity 68 includes a wall 62 and a first flange 64 that is canted radially outward and in a direction opposite the inlet flow direction I. A second flange 66 extends from the wall 62, and the first flange 64 is arranged radially outward of the second flange 66. The add heat cavity 68 provides an annular passage around the compressor inlet 17. The wall 62 and first flange 64 provide a pocket 67 for collecting debris from the fluid flowing through the add heat duct 60.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A compressed air unit comprising:

a housing having a cavity with a motor, the housing providing a compressor inlet defining an inlet flow direction for a fluid;

a compressor rotor connected to the motor and rotatable about an axis, the compressor inlet in fluid communication with the compressor rotor;

an inlet duct in fluid communication with the cavity and defining a cooling flow direction; and a supply cavity provided by the housing and fluidly connecting the compressor inlet and the inlet duct, the supply cavity having a wall and a first flange canted relative to the wall directing the fluid from the compressor inlet in a supply flow direction transverse to the cooling flow direction.

2. The unit according to claim 1, wherein the supply and cooling flow directions are at an acute angle relative to one another.

3. The unit according to claim 1, wherein the first flange and wall form a pocket for collecting debris from the fluid flowing from the supply flow direction to the cooling flow direction.

4. The unit according to claim 1, wherein the first flange is canted radially outward toward the wall and in a direction opposite the inlet flow direction.

5. The unit according to claim 4, wherein a second flange extends from the wall in the inlet flow direction, the first flange arranged radially outward of the second flange.

6. The unit according to claim 1, wherein an add heat cavity is provided by the housing and fluidly connected between the compressor inlet and a compressor outlet, the add heat cavity having a second wall having a second flange canted radially outward and in an opposite direction of the inlet flow direction.

* * * * *

UNITED STATES PATENT AND TRADEMARK OFFICE

CERTIFICATE OF CORRECTION

PATENT NO. : 7,575,421 B2
APPLICATION NO. : 10/978641
DATED : August 18, 2009
INVENTOR(S) : McAuliffe et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1245 days.

Signed and Sealed this

Seventh Day of September, 2010

David J. Kappos

David J. Kappos
*Director of the United States Patent and Trademark Office*